US006181223B1

(12) United States Patent
Ito

(10) Patent No.: US 6,181,223 B1
(45) Date of Patent: Jan. 30, 2001

(54) DIELECTRIC DUPLEXER DEVICE

(75) Inventor: Kenji Ito, Matsuzaka (JP)

(73) Assignee: NGK Spark Plug Co., Ltd., Aichi-ken (JP)

( * ) Notice: Under 35 U.S.C. 154(b), the term of this patent shall be extended for 0 days.

(21) Appl. No.: 09/222,704

(22) Filed: Dec. 29, 1998

(51) Int. Cl.[7] ..... H01P 1/20; H01P 5/12
(52) U.S. Cl. ..... 333/206; 333/204; 333/134
(58) Field of Search ..... 333/202, 206, 333/222, 134, 204

(56) References Cited

U.S. PATENT DOCUMENTS

| | | | | |
|---|---|---|---|---|
| 4,879,533 | * | 11/1989 | De Muro et al. | 333/206 |
| 5,079,528 | * | 1/1992 | Yorita et al. | 333/206 |
| 5,374,910 | | 12/1994 | Yamagata | 333/206 |
| 5,563,560 | * | 10/1996 | Komatsu et al. | 333/206 |

FOREIGN PATENT DOCUMENTS

| | | |
|---|---|---|
| 06125206 | 5/1994 | (EP) . |
| 0 654 841 | 5/1995 | (EP) . |
| 07170109 | 7/1995 | (EP) . |
| 07176913 | 7/1995 | (EP) . |
| 07336109 | 12/1995 | (EP) . |
| 05243816 | 9/1993 | (JP) . |
| 05259706 | 10/1993 | (JP) . |
| 95/30250 | 11/1995 | (WO) . |

OTHER PUBLICATIONS

JP Pat. Kokai No. HO4–356801, May 7, 1993, Sec. 1359, vol. 17, No. 223, p. 74 (Abstract Only).
JP Pat. UM Kokai No. 2–137104, Nov. 15, 1990.
JP Pat. Kokai No. HO3–292002, Sec. E, Sec. No. 1184, vol. 16, No. 130, p. 24 (Abstract Only).
JP Pat. Kokai No. S61–0208902. Corresponds to U.S. Patent No. 4,703,391.
JP Pat. Kokai No. S630–311801, Apr. 14, 1989, Sec. E, Sec. No. 743, vol. 13, No. 155, p. 17 (Abstract Only).

* cited by examiner

*Primary Examiner*—Robert Pascal
*Assistant Examiner*—Patricia T. Nguyen
(74) *Attorney, Agent, or Firm*—Larson & Taylor PLC

(57) ABSTRACT

A dielectric duplexer device comprises a dielectric duplexer including a plurality of resonators arranged in parallel along a same direction, and a coupling circuit coupled to related ones of the resonators, and is adapted to show a surface area appropriately selected for each of capacitor electrodes, other electrodes and components to be formed on a laminated dielectric body, wherein the coupling circuit is arranged on the laminated dielectric body (10*a;* 10*b;* 10*c*) which comprises a plurality of dielectric sheet members (10*a* through 11*e*) and is bonded to an open-circuit end surface of the dielectric duplexer (1*a;* 1*b;* 1*c*) at a rear layered side portion to produce an intended transmission/reception circuit.

9 Claims, 8 Drawing Sheets

DIELECTRIC DUPLEXER DEVICE

BACKGROUND OF THE INVENTION

The present invention relates to a dielectric duplexer device comprising a plurality of resonators and adapted to be suitably be used for a mobile telephone set such as an automobile telephone set or a portable telephone set.

PRIOR ART

Japanese Patent Kokai No. 63-311801 discloses a dielectric duplexer device comprising a dielectric duplexer including a plurality of resonators arranged in parallel in a direction on a dielectric ceramic block which has outer peripheral surface coated with an grounding conductor except an open-circuit end surface where through holes of the resonators are exposed. The dielectric duplexer is mounted on a substrate provided with a coupling circuit which is coupled to the related resonators of the dielectric duplexer. The dielectric ceramic block of said dielectric duplexer and said coupling circuit are housed in and covered by a metal casing. Various similar dielectric duplexer devices have also been proposed to date.

In such a dielectric duplexer device, circuit elements such as coupling capacitors for LC-coupling the resonators are mounted on the substrate and electric paths are formed on the substrate to produce required circuits. The circuit elements and electric paths are then covered by a metal casing operating as shield case. Input/output electrodes are formed on the substrate for connection with external electric paths to realize the dielectric duplexer device in the form of an integral unit that provides easy handling. Additionally, such an arrangement provides an enhanced degree of design freedom because coupling capacitors and other elements may be mounted independently on the substrate so that appropriate values may be selected for the circuit constants.

However, with such a conventional arrangement, each of the resonators is provided with a metal terminal driven into it in order to realize an LC-coupling for the resonators and the metal terminals are connected to related electric paths formed on the printed substrate or board, while coupling capacitors have to be mounted on the substrate, so that, as a whole, the dielectric duplexer requires a cumbersome operation of connecting wires and involves a considerable number of assembling steps reflecting a complicated circuit design and a clumsy circuit arrangement.

In an attempt to avoid the above problem, the inventor of the present patent application proposed a dielectric duplexer assembly comprising a laminated circuit arrangement for coupling circuit realized by laminating a plurality of dielectric sheet materials and arranged on the open-circuit end surface of the dielectric duplexer, the coupling circuits being connected to the related resonators of the transmitter section and/or the receiver section of the duplexer.

FIG. 1 of the accompanying drawings shows such a dielectric duplexer device A, in which connector pads P are exposedly arranged on a layered side portion of a laminated circuit arrangement B where the layered side portion of the laminated circuit arrangement appears, and a flat side portion perpendicular to said layered side portion of the laminated circuit arrangement B is bonded to the open-circuit end surface of a dielectric duplexer C comprising a plurality of resonators D. However, as a result of a series of experiments, it has been found that the previously proposed device is accompanied by the following problems.

a) The laminated circuit arrangement B is arranged so that one of the layered side portions of dielectric sheet members (opposite side portions along which the dielectric sheet members are laminated) is disposed on the surface of the printed circuit board and thus forms a boundary surface that is less smooth. There are arisen problems that floatings and gaps may be produced between the surface of the printed circuit board and the layered side portion which is brought into contact with that surface. In short, this conventional arrangement does not provide a satisfactory flatness, and the dielectric duplexer and the laminated circuit arrangment cannot be mounted stably on the printed circuit board.

b) A large surface area of the flat side portion perpendicular to the layered side portion of the laminated circuit arrangment B results in a large height of the device to baffle the effort for downsizing the portable telephone set incorporating the device.

Thus, the surface area is subjected to limitations to consequently limit the surface area of the capacitor electrodes arranged on the surface of the dielectric laminated circuit arrangement and hence the allowable capacitance range for the capacitors.

It is, therefore, an object of the present invention is to provide a dielectric duplexer device that is capable of overcoming these problems.

SUMMARY OF THE INVENTION

According to the invention, there is provided a dielectric duplexer device comprising a dielectric duplexer having a plurality of resonators arranged in parallel in a direction and divided into two sections, a transmitter section and a receiver section, and a coupling circuit connected to predetermined ones of the resonators of the transmitter section and/or receiver section of the dielectric duplexer, wherein said coupling circuit comprises a laminated circuit arrangement including a plurality of dielectric sheet members and bonded to an open-circuit end surface of the dielectric duplexer at a lateral layered side portion thereof so that an intended transmission/reception circuit is formed.

Such an arrangement, where the dielectric laminated circuit arrangement is bonded to the open-circuit end surface of the dielectric duplexer to provide a coupling circuit, makes the assembly show a neat and simple profile and allows appropriate values to be selected for the circuit constants.

Additionally, since the dielectric laminated circuit arrangement is bonded to the open-circuit end surface of the dielectric duplexer at a rear layered side portion, a highly smooth entire surface of the outermost or lowest dielectric sheet member is made to face and stably mounted on a printed circuit substrate.

Then, the height, or thickness, of the dielectric laminated circuit arrangement is invariable to make it compatible with the effort of downsizing the portable telephone set comprising it, if the surface area of the dielectric sheet members to be laminated is changed appropriately.

Preferably, the dielectric duplexer may comprise a plurality of coaxial type resonators arranged in parallel, each being made of a dielectric block which has a single through hole extending therethrough and having its inner surface coated with an inner conductor, an outer surface coated with a grounding conductor and an open-circuit end surface having no conductor.

With such an arrangement, the characteristics of each of the coaxial type resonators can be regulated independently to optimize the operating characteristics of the dielectric duplexer as a whole. The coaxial type resonators may be unitized in advance or assembled together by rigidly mounting them on the substrate on a one by one basis.

Alternatively, the dielectric duplexer may comprise a plurality of coaxial type resonators provided on a single dielectric block which has a plurality of through holes extending in parallel along a same direction therethrough, an outer surface coated with a grounding conductor and an open-circuit end surface having no conductor, each through hole having an inner surface coated with an inner conductor.

With such an arrangement, the dielectric duplexer can be mounted on the substrate with ease because it is made of a single dielectric block.

According to a preferable embodiment, the laminated circuit arrangement may constitute a coupling circuit having a low pass filter circuit section coupled to the resonators of one of the resonator sections and a band pass filter circuit section coupled to the resonators of the other resonator section.

According to another preferable embodiment, the laminated circuit arrangement may constitute a coupling circuit having a low pass filter section coupled to the resonators of one of the resonator sections and bonded to the region of that resonator section on the open-circuit end surface of the dielectric duplexer at a rear layered side portion thereof. A band pass filter circuit section may be formed by arranging conductor layers disposed on the open-circuit end surface of the resonators corresponding to the region of the other resonator section and connected to the inner conductors of the respective resonators of that section, said conductor layers being capacitively coupled with each other.

Then, the laminated circuit arrangement can provide inductors easily by forming patterned conductors having a desired profile on the surface of the dielectric sheet members so that the laminated circuit arrangement may be used exclusively for forming a low pass filter circuit section including a plurality of inductors, while the band pass filter circuit section including only capacitors may be provided by forming a conductor film coat on spot facings in a conventional manner or by forming conductor layers of patterned conductors connected to the inner conductors of the respective resonators by direct printing and capacitively coupling the conductor layers.

DETAILED DESCRIPTION OF THE PREFERRED EMBODIMENTS

Now, the present invention will be described in greater detail by referring to the accompanying drawings that illustrate preferred embodiments of the invention. Note that the circuit diagram of FIG. 5 applies to the transmission/reception circuits of all the embodiments.

Figure 1:
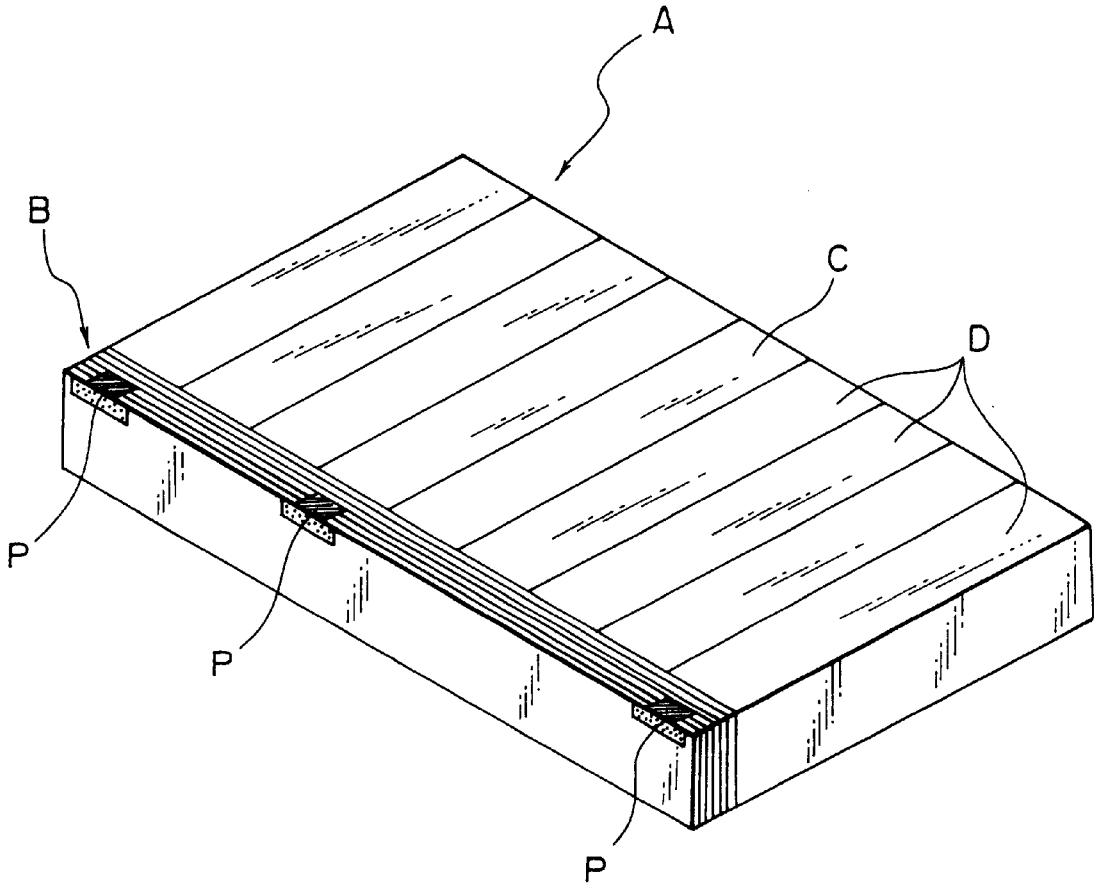
FIG. 1 is a schematic perspective view showing a dielectric duplexer device previously proposed but not published.
Figure 2:
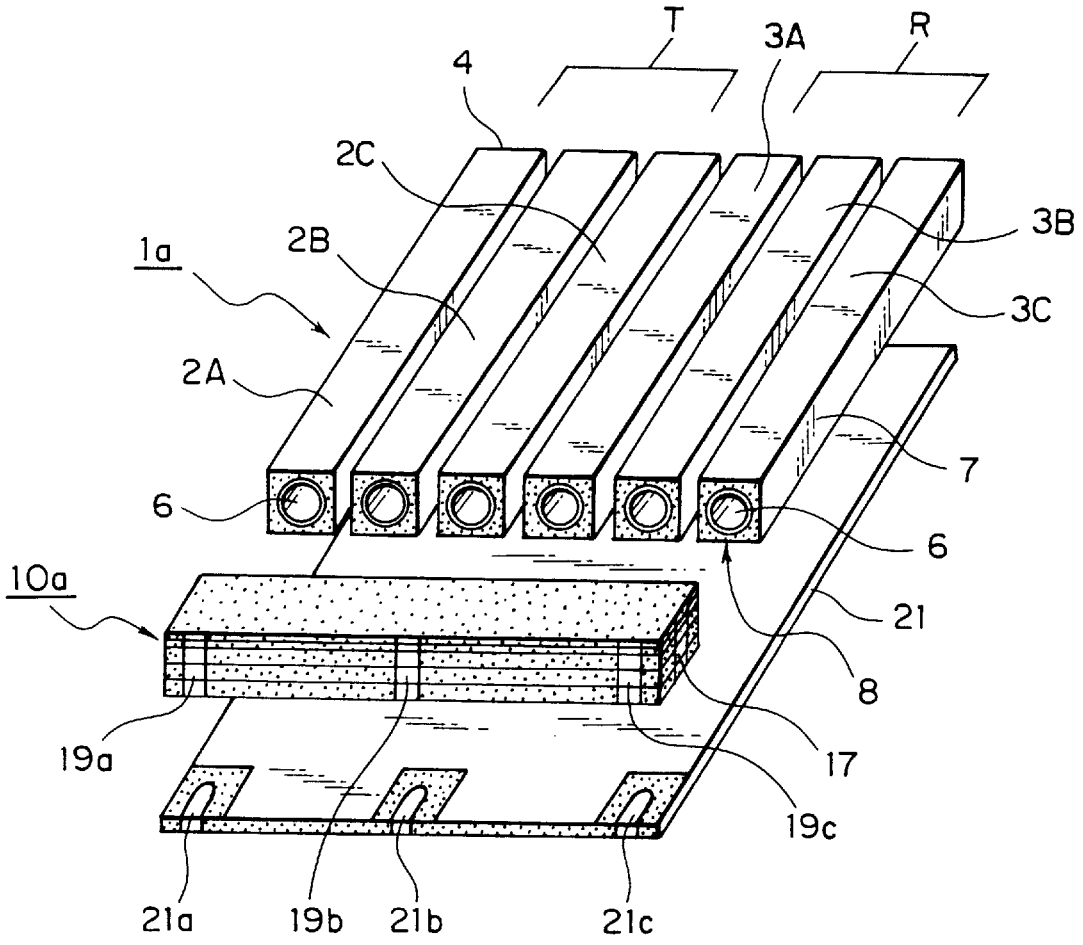
FIG. 2 is an exploded schematic perspective view showing an embodiment of dielectric duplexer device according to the invention.

FIG. 2 schematically illustrates an embodiment of dielectric duplexer device according to the invention. The illustrated dielectric duplexer device comprises a dielectric duplexer 1*a* including a total of six coaxial type resonators 2A through 2C and 3A through 3C, and a laminated circuit arrangement 10*a*. The coaxial type resonators are divided into two groups to provide a 3-pole type transmitter section T including the three resonators 2A through 2C and a 3-pole type receiver section R including the three resonators 3A through 3C, and are arranged side by side and bonded together.

Each of the resonators 2A through 2C and 3A through 3C comprises a dielectric ceramic block 4 prepared by sintering a dielectric ceramic material typically containing titanium oxide or barium oxide.

Figure 3:
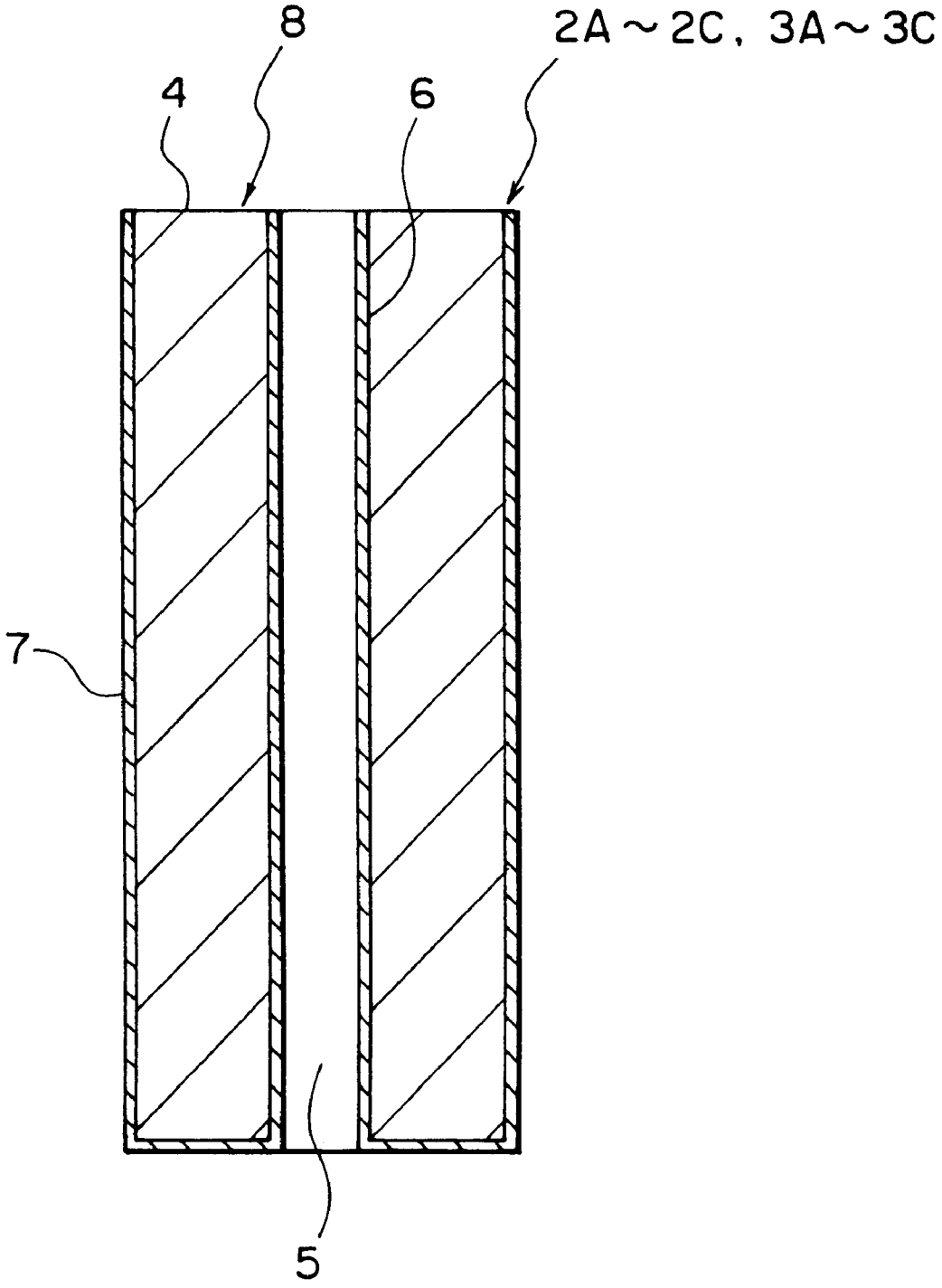
FIG. 3 is a schematic longitudinal cross sectional side view showing one of coaxial type resonators in the embodiment of FIG. 2.
Figure 5:
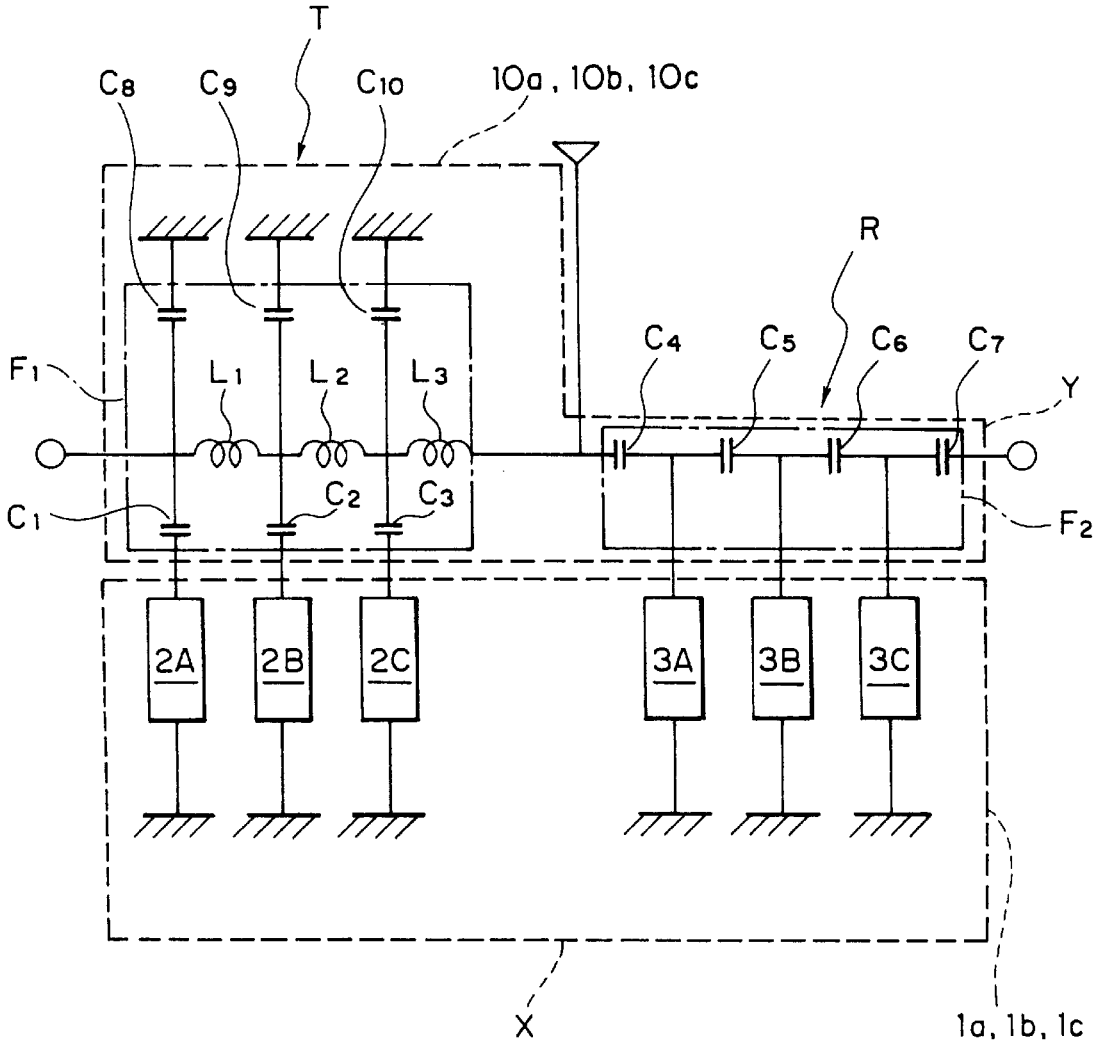
FIG. 5 is a circuit diagram of an equivalent circuit of a dielectric duplexer device according to the invention.

As shown in FIG. 3, each resonator includes a through hole 5 provided through the dielectric ceramic block 4 and an inner conductor layer 6 applied to the inner surface or inner peripheral wall of the through hole 5. The exposed outer surfaces of each dielectric block 4 are substantially coated with a grounding conductor 7 except the open-circuit end surface 8 of the dielectric block 4 where one of the openings of the respective through hole 5 is exposed. All the resonators 2A through 2C and 3A through 3C have a same resonant length substantially equal to a quarter of the resonance frequency $\lambda$, or $\lambda/4$. A resonator circuit X as shown by the circuit diagram of FIG. 5 is formed by the resonators 2A through 2C and 3A through 3C.

The laminated circuit arrangement 10*a* is arranged to cover the entire open-circuit end surface of the dielectric duplexer 1*a* including the coaxial type resonators 2A through 2C and 3A through 3C. The dielectric duplexer device typically has dimensions of a height of less than 2 mm, a length of 11 mm and a width of 11 mm (design example).

Then, the dielectric duplexer device is mounted on a substrate 21.

Alternatively, the coaxial type resonators 2A through 2C and 3A through 3C may not be bonded together to maintain the parallel arrangement and may well be mounted individually on the substrate to realize such a parallel arrangement.

Furthermore, the dielectric duplexer device may be provided with a metal casing (not shown) functioning as shield casing.

The laminated circuit arrangement 10*a* is formed by sequentially laying a plurality of rectangular dielectric sheet members 11*a*, 11*b*, 11*c* 11*d* and 11*e* each of which is typically made of glass ceramic, a composite material containing glass and dielectric ceramic or a low melting point oxide and collectively sintering them. A rear layered side portion of the laminated circuit arrangement 10*a* shows a rectangular contour adapted to rightly cover the open-circuit end surface 8 of the dielectric duplexer 1*a*.

The laminated circuit arrangement 10*a* formed by simply laying the rectangular dielectric sheet members 11*a*–11*e* provides a coupling circuit Y comprising a low pass filter circuit section F1 and a band pass filter circuit section F2 as shown in FIG. 5. Since the laminated circuit arrangement

10*a* is produced as a single chip by collectively sintering the dielectric sheet members 11*a*, 11*b*, 11*c*, 11*d* and 11*e*, a dielectric duplexer device having a neat and simple box-like profile can be realized with ease simply by bonding the laminated circuit arrangement 10*a* onto the open-circuit end surface 8 of the dielectric duplexer 1*a*.

Each of the dielectric sheet members 11*a* through 11*e* has an upper surface and a peripheral edges provided with a patterned and printed conductor.

The specific configuration of each of the dielectric layers 11*a* through 11*e* will now be described by referring to FIG. 4 which illustrates the laminated circuit arrangement 10*a* in the embodiment of FIG. 2 as viewed from the bonding interface.

Figure 4:
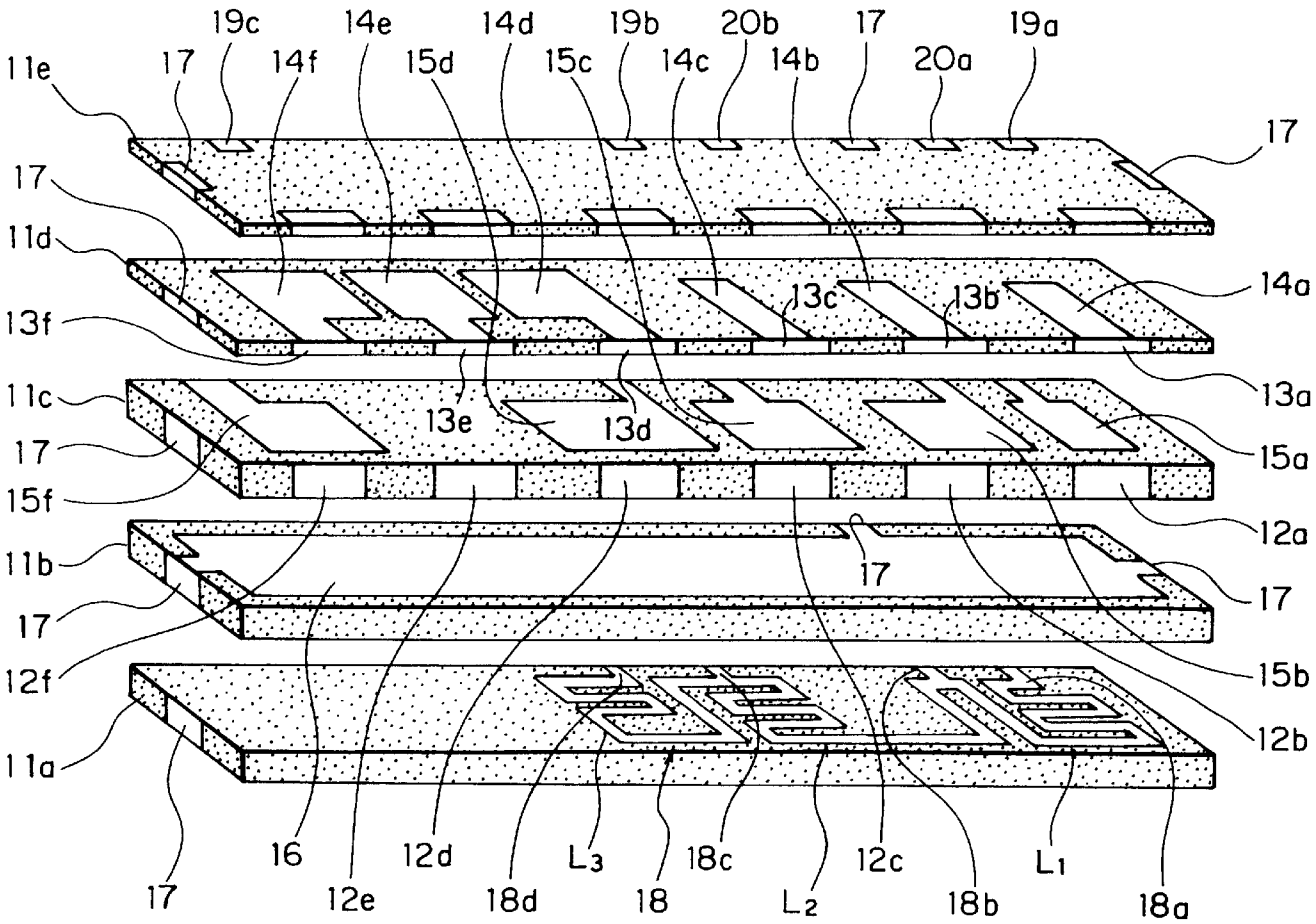
FIG. 4 is an exploded schematic perspective view showing the laminated circuit arrangement in the embodiment of FIG. 1 as viewed from the bonding interface.

As seen from FIG. 4, the dielectric sheet member 11*c* is provided with ledge electrodes 12*a*, 12*b*, 12*c*, 12*d*, 12*e* and 12*f* on a rear edge thereof. The ledge electrodes 12*a* through 12*f* are arranged to be connected to the inner conductors 6 of the respective resonators 2A through 2C and 3A through 3C in the dielectric duplexer 1A. Additionally, the edge electrodes 12*a* through 12*f* are connected to respective edge electrodes 13*a*, 13*b*, 13*c*, 13*d*, 13*e* and 13*f* arranged on the corresponding rear edge of the dielectric sheet member 11*d* to be placed directly on the dielectric sheet member 11*c* and hence to respective capacitor electrodes 14*a*, 14*b*, 14*c*, 14*d*, 14*e* and 14*f* provided on an upper surface of the dielectric sheet member 11*d* and extending from the edge electrodes 13*a* through 13*f*, respectively.

Meanwhile, on the upper surface of the dielectric sheet member 11*c* are provided capacitor electrodes 15*a*, 15*b*, 15*c*, 15*d* and 15*f* which are arranged to be held in juxtaposition respectively with the capacitor electrodes 14*a*, 14*b*, 14*c*, 14*d* and 14*f* on the dielectric sheet member 11*d* and separated respectively from the latter by a distance defined by the thickness of the dielectric sheet member 11*d*. Thus, capacitors C1, C2, C3, C4 and C7 are formed respectively between the capacitor electrodes 14*a* and 15*a*, between the capacitor electrodes 14*b* and 15*b*, between the capacitor electrodes 14*c* and 15*c*, between the capacitor electrodes 14*d* and 15*d* and between the capacitor electrodes 14*f* and 15*f*. Additionally, a capacitor C5 is formed between the capacitor the electrodes 14*d* and 14*e* arranged adjacently on the upper surface of the dielectric sheet member 11*d* while a capacitor C6 is formed between the capacitor electrodes 14*e* and 14*f* also arranged adjacently on the upper surface of the dielectric layer 1*d*.

The dielectric sheet member 11*b* provided with a shield electrode layer 16 on an upper surface thereof so that capacitors C8, C9 and C10 are formed between it and the capacitor electrodes 15*a*, 15*b* and 15*c* on the dielectric sheet member 11*c*, respectively. The shield electrode layer 16 is connected to a grounding electric path by way of grounding pads 17 which are provided respectively on the front edge and the opposite lateral edges of the respective dielectric sheet members 11*a* through 11*e*.

The dielectric sheet member 11*a* includes a meandering electric path 18 on the upper surface thereof with starting and terminating connector edges 18*a* and 18*d* and a pair of branched connector edges 18*b* and 18*c*, which connector edges define three inductors L1, L2 and L3.

The connector edge 18*a* is connected to a transmission pad 19*a* formed on the front edge of the respective dielectric sheet members 11*a* through 11*e* with the capacitor electrode 15*a* on the dielectric sheet member 11*c*. The connector edges 18*b* and 18*c* are connected to relay paths 20*a* and 20*b* also formed on the front edge of the respective dielectric sheet members 11*a* through 11*e* with the capacitor electrodes 15*b* and 15*c* on the dielectric sheet member 11*c*. Then, the connector edge 18*d* is connected to an antenna pad 19*b* formed on the front edge of the respective dielectric sheet members 11*a* through 11*e*.

Finally, capacitor electrode 15*d* on the dielectric sheet member 11*c* is also connected to the antenna pad 19*b* and the capacitor electrode 15*f* is connected to reception pad 19*c* formed on the front edge of the respective dielectric sheet members 11*a* through 11*e*.

The pads 19*a* through 19*c*, the grounding pad 17 and the relay paths 20*a* and 20*b* are produced by metallizing the conductive material on the front layered side portion of the laminated circuit arrangement 10*a* formed as a result of laying the dielectric sheet members 11*a* through 11*e*.

With the laminated circuit arrangement 10*a* having the above described configuration the capacitor electrodes and the inductors are connected by means of the metallized pads 19*a* through 19*c* and the relay paths 20*a* and 20*b* on the front side portion. Therefore, there is no need of boring through holes in the dielectric sheet members or substrate. While electric connections by way of such through holes in conventional dielectric duplexer devices require a process of filling the holes typically by using a printing technique to consequently reduce the productivity of manufacturing dielectric duplexer devices, the present invention remarkably improves the productivity of manufacturing devices.

Then, simply by bonding the laminated circuit arrangement 10*a* of a plurality of dielectric sheet members 11*a* through 11*e* to the open-circuit end surfaces of the dielectric ceramic blocks 4 at the rear layered side portion where the edge electrodes 12*a* through 12*f* and 13*a* through 13*f* are arranged, the low pass filter circuit section Fl comprising capacitors C1 through C3 and inductors L1 through L3 is coupled to the resonators 2A through 2C of the transmitter section T and the band pass filter circuit section F2 comprising capacitors C4 through C7 is coupled to the resonators 3A through 3C of the receiver section R to produce a coupling circuit Y. Thus, there is provided a transmission/reception circuit comprising the coupling circuit Y and the resonator circuit X including the resonators 2A through 2C of the transmitter section T and the resonators 3A through 3C of the receiver section R and having a circuit configuration as shown in FIG. 5.

As described above, the dielectric duplexer 1*a* now unitized with the laminated circuit arrangement 10*a* is mounted on a substrate 21 with the pads facing outside as shown in FIG. 2. The substrate 21 is provided in advance with a transmission terminal 21*a*, an antenna terminal 21*b* and a reception terminal 21*c* adapted to be connected to external electric paths respectively. Thus, the transmission/reception circuit comprising the dielectric duplexer 1*a* and the laminated circuit arrangement 10*a* will be connected to the external electric paths by connecting the transmission pad 19*a*, the antenna pad 19*b* and the reception pad 19*c* to the transmission terminal 21*a*, the antenna terminal 21*b* and the reception terminal 21*c*, respectively. It will be appreciated that, since the bottom surface of the laminated circuit arrangement 10*a*, that is the bottom surface of the lowerst dielectric sheet member is placed on the surface of the substrate 21 for supporting the laminated circuit arrangement 10*a*, no floatings nor gaps will be produced between the laminated circuit arrangement 10*a* and the substrate 21 and hence the laminated circuit arrangement 10*a* will be stably mounted on the substrate 21.

Additionally, the surface of the substrate 21 supporting the laminated circuit arrangement 10*a* can be modified by modifying the profile and the size of the dielectric sheet members practically without limitations to allow an enhanced degree of design freedom for designing the electrode pattern on each of the dielectric sheet memebers.

Moreover, the dielectric duplexer device is unitized so that it can conveniently be used in a mobile telephone set such as a portable telephone set once the input terminal 21*a*, the antenna terminal 21*b* and the output terminal 21*c* are connected to respective external electric paths.

As described above, the dielectric duplexer 1*a* is produced by arranging a plurality of coaxial type resonators 2A through 2C and 3A through 3C in parallel on a substrate 21 and hence the characteristics of each of the coaxial type resonators 2A through 2C and 3A through 3C can be regulated independently to optimize the operating characteristics of the dielectric duplexer 1*a* as a whole. The coaxial type resonators 2A through 2C and 3A through 3C may be unitized in advance or assembled together by rigidly mounting them on the substrate 21 on a one by one basis.

Figure 6:
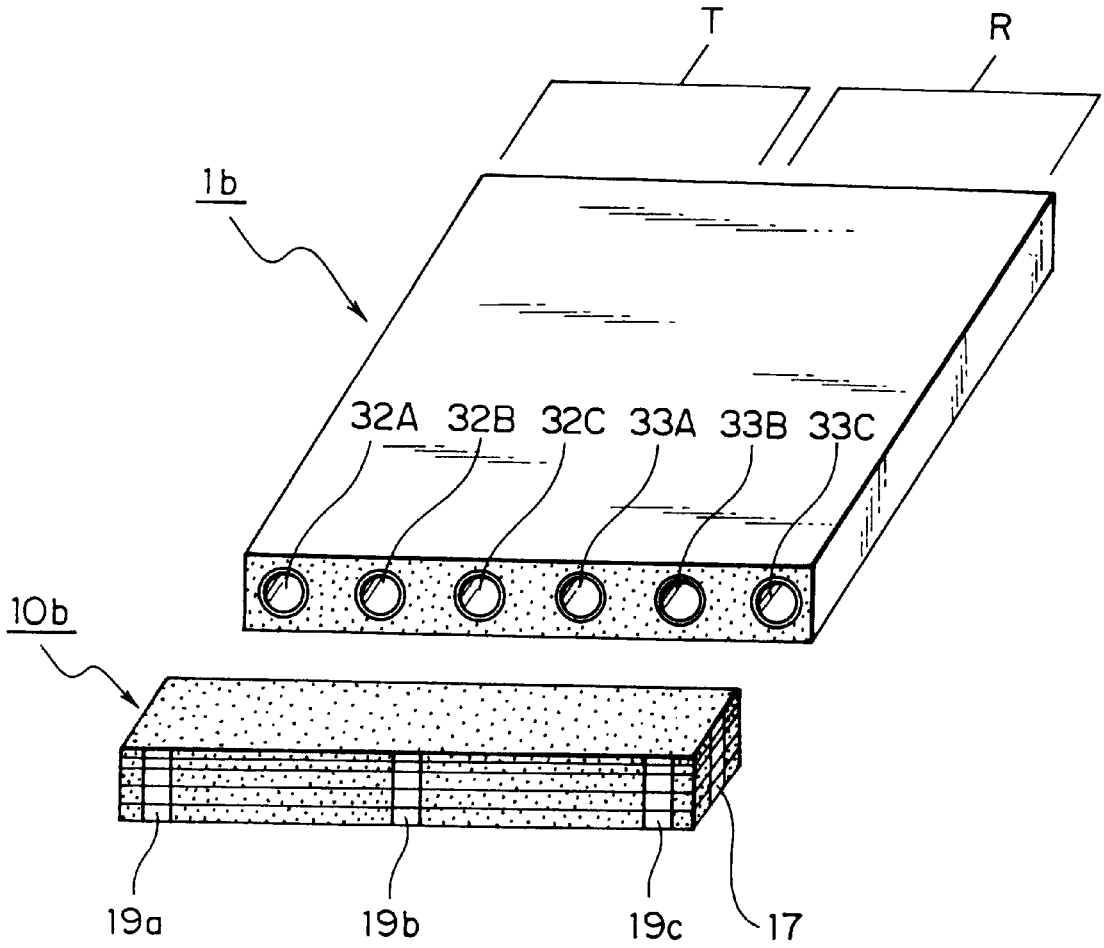
FIG. 6 is an exploded schematic perspective view showing a dielectric duplexer device according to another embodiment of the invention.
Figure 7:
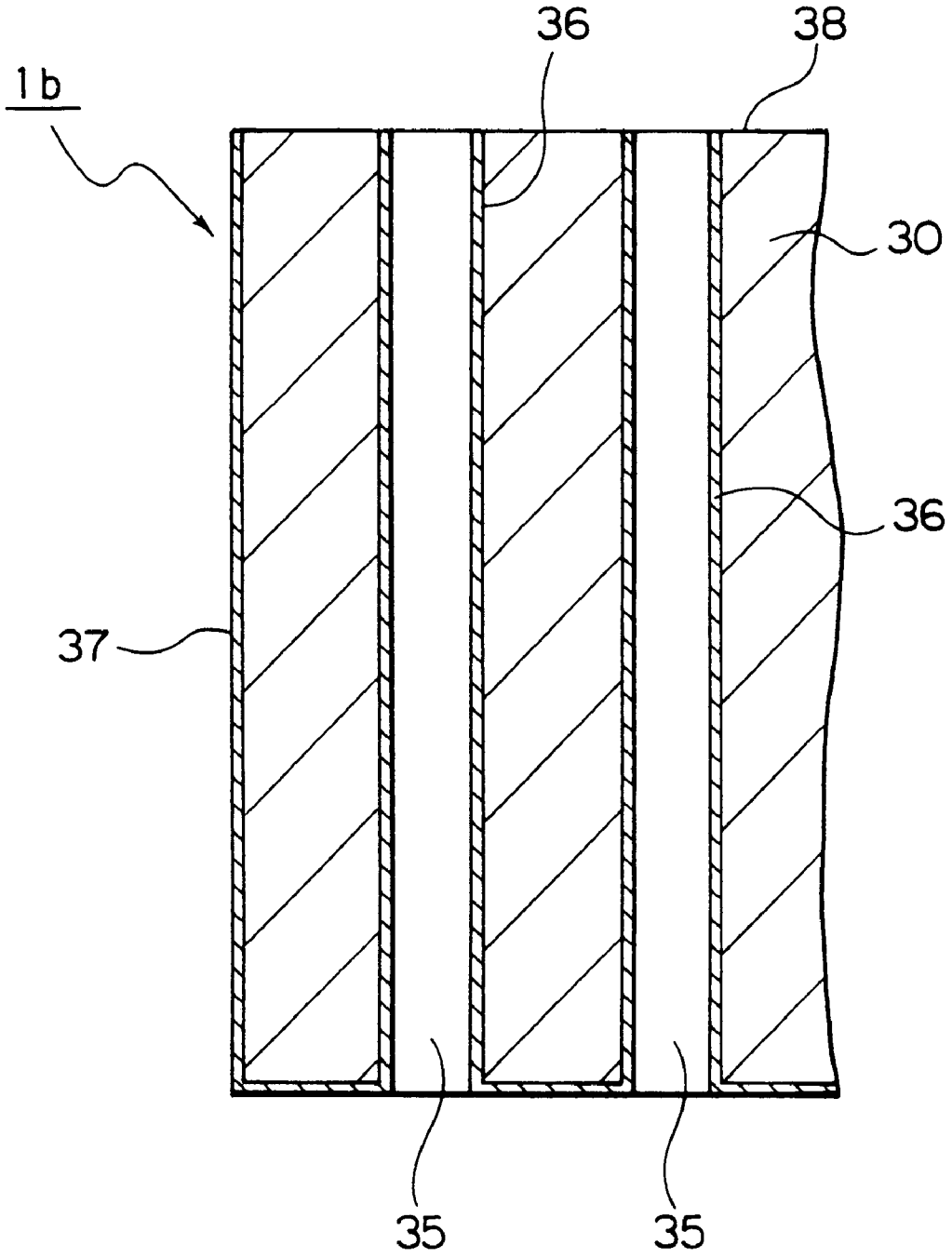
FIG. 7 is a schematic longitudinal cross sectional view showing a part of the dielectric duplexer in the embodiment of FIG. 6.

FIGS. 6 and 7 schematically another embodiment of a dielectric duplexer device according to the invention in which a dielectric duplexer 1*b* is provided on a single dielectric ceramic block 30 of a rectangular parallelepiped shape. The dielectric ceramic block 30 includes three resonators 32A through 32C for a transmitter section T and three resonators 33A through 33C for receiver section R. The resonators are arranged in parallel with respect to each other along a same direction.

As shown in FIG. 7, each of the resonators comprises a through hole 35 provided through the dielectric ceramic block 30 and an inner conductor layer 36 applied to the inner peripheral surface of the through hole 35. The exposed outer surfaces of the dielectric block 30 are substantially coated with a grounding conductor 37 except the open-circuit end surface 38 of the dielectric block 30 or the dielectric duplexer 1*b* where one of the openings of the respective through hole 35 is exposed.

In this instance again, a similar laminated circuit arrangement 10*b* is provided to cover the open-circuit end surface 38 of the dielectric duplexer 1*b* at a rear layered side portion thereof. Since the dielectric duplexer 1*b* is physically made of a single block, it can be mounted on the substrate very easily.

In each of the above described embodiments, the laminated circuit arrangement 10*a* or 10*b* is arranged to cover the entire open-circuit end surface of the resonators.

Figure 8:
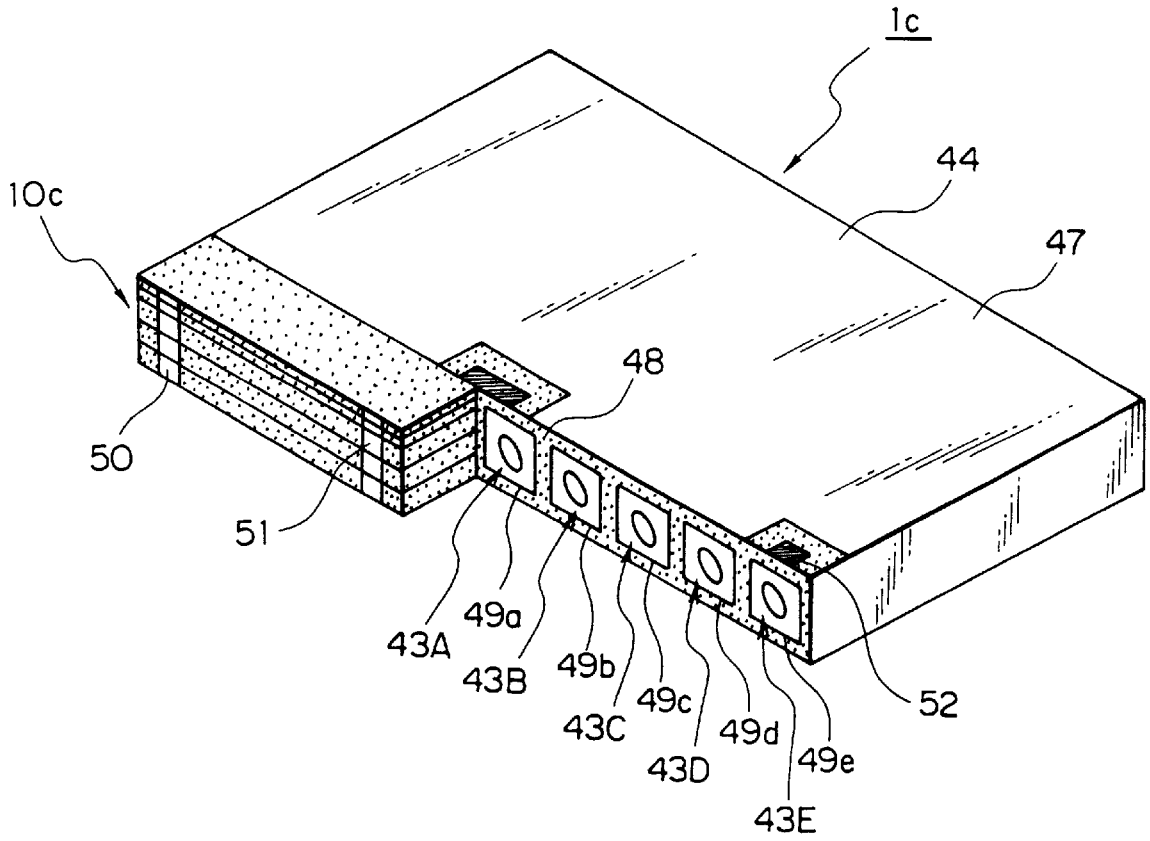
FIG. 8 is a schematic perspective view showing a further embodiment of a dielectric duplexer device according to the invention.

Referring to FIG. 8, there is llustrated a further embodiment of a dielectric duplexer device according to the invention in which a laminated circuit arrangement 10*c* is so arranged that only the open-circuit end surface of the transmitter section T of a dielectric duplexer 1*c* is covered by it.

As will be seen in FIG. 8, the laminated circuit arrangement 10*c* is connected only to the transmitter section T of dielectric duplexer 1*c*. The receiver section R of the dielectric duplexer 1*c* comprises five resonators 43A, 43B, 43C, 43D and 43E. Each of the resonators comprises a through hole provided through the dielectric ceramic block 44 and an inner conductor layer applied to the inner peripheral surface of the through hole. The exposed outer surfaces of the dielectric block 44 are substantially coated with a grounding conductor 47 except the open-circuit end surface 48 of the dielectric block 44 or the dielectric duplexer 1*c* where one of the openings of the respective through hole is exposed.

Additionally, conductor layers 49*a*, 49*b*, 49*c*, 49*d* and 49*e* are formed on the open-circuit end surfaces of the respective resonators 43A through 43E and connected to the respective inner conductors to form coupling capacitors between adjacent ones of the conductor layers 49*a* through 49*e*. The embodiment of FIG. 8 further comprises a transmission pad 50, an antenna pad 51 and a reception pad 52.

As described above, in a dielectric duplexer device according to the invention, a coupling circuit is formed by laminating a plurality of dielectric sheet members and bonded to the open-circuit end surface of the dielectric duplexer at a rear layered side portion thereof in order to couple the coupling circuit to the related resonators of the transmitter section and/or the receiver section of the dielectric duplexer to form an intended transmission/reception circuit. The bove arrangement provides the following advantages.

1) Since a rear layered side portion of the circuit arrangement is bonded to the open-circuit end surface of the dielectric duplexer, the outermost or bottom surface of the laminated dielectric sheet members that is flat and smooth is placed on a substrate so that it can be stably held on the printed circuit substrate or board.

2) Since the total height of the laminated circuit arrangement is made invariable if the surface area of the respective dielectric sheet members is modified so that the laminated dielectric sheet members do not baffle the effort for downsizing the mobile telephone set into which the dielectric duplexer device is to be incorporated. Therefore, capacitor electrodes and inductors may be formed appropriately on the laminated circuit arrangement to optimize the operating characteristics of the dielectric duplexer device.

3) The dielectric duplexer assembly can be made to show a neat and simple and profile and a filter circuit can be dimensionally reduced to reduce the surface area of the substrate for carrying the dielectric duplexer device. Thus, the entire assembly can be downsized.

4) The conductor patterns arranged in the laminated circuit arrangement and the pads arranged on the surface of the substrate may be connected only at the external electrodes arranged on the front layered side portion of the laminated circuit arrangement to eliminate the need of boring through holes in the dielectric sheet members and hence a process of filling the holes by means of a printing technique and consequently improve the productivity of manufacturing such dielectric duplexer devices.

5) A filter circuit can be constituted only by the dielectric duplexer 1*a*, 1*b* or 1*c* and the laminated dielectric sheet members 11*a* through 11*e* to simplify the wiring operation to be conducted on the substrate and hence the process of manufacturing such dielectric duplexer devices.

6) A filter circuit can be constituted only by the dielectric duplexer 1*a*, 1*b* or 1*c* and the laminated dielectric sheet members 11*a* through 11*e* to improve the mechanical strength and the impact resistance of the dielectric duplexer device.

7) Since the coupling circuit Y is confined within the laminated dielectric sheet members, it is shielded from the external atmosphere and minimally affected by external factors such as moisture and mechanical impact and hence the operating characteristics of the dielectric duplexer device will be stabilized.

8) Since the coupling circuit is formed by a laminated circuit arrangement, appropriate values may be selected for the circuit constants to provide an enhanced degree of design freedom for designing a dielectric duplexer device.

9) When the laminated circuit arrangement is formed to a single chip by laying and baking a plurality of dielectric sheet members, the laminated circuit arrangement can be mounted on the dielectric duplexer 1*a*, 1*b* or 1*c* by simply bonding them together to simplify the manufacturing process and make such dielectric duplexer devices adapted to mass production.

What is claimed is:

1. A dielectric duplexer device comprising:

a dielectric duplexer having a plurality of resonators arranged in parallel along a same direction and divided into two sections, a transmitter section and a receiver section each of said resonators having an inner conductor; and a laminated circuit arrangement for a coupling circuit intended to be connected to predetermined ones of the resonators of the transmitter section or receiver section of the dielectric duplexer, said laminated circuit arrangement including a plurality of laminated dielectric sheet members and a plurality of edge electrodes at a rear layered side portion thereof arranged to be electrically connected to said predetermined ones of the resonators and being sized so as to cover an entire open-circuit and surface of the dielectric duplexer so that an intended transmission/reception circuit is formed.

2. A dielectric duplexer device as claimed in claim 1, wherein said laminated circuit arrangement is mounted on a printed circuit substrate in such a manner that a smooth entire surface of the outermost or lowest dielectric sheet member of the laminated dielectric sheet members is brought into contact with the printed circuit substrate.

3. A dielectric duplexer device as claimed in claim 1, wherein said dielectric duplexer comprises a plurality of coaxial type resonators in parallel, each of said resonators being made of dielectric block having a single through hole extending therethrough and having its inner surface coated with said inner conductor, an outer surface coated with a grounding conductor and an open-circuit end surface having no conductor.

4. A dielectric duplexer device as claimed in claim 3, wherein said coaxial type resonators are assembled together by rigidly mounting them on a printed circuit substrate on a one by one basis.

5. A dielectric duplexer device as claimed in claim 1, wherein said dielectric duplexer comprises a plurality of coaxial type resonators provided on a single dielectric block which has a plurality of through holes extending in parallel along a same direction therethrough, an outer surface coated with a grounding conductor and an open-circuit end surface having no conductor, each through hole having an inner surface coated with an inner conductor.

6. A dielectric duplexer device as claimed in claim 1, wherein said laminated circuit arrangement includes a coupling circuit having a low pass filter circuit section coupled to the resonators of one of the resonator sections and a band pass filter circuit section coupled to the resonators of the other resonator section.

7. A dielectric duplexer device as claimed in claim 1, wherein said laminated circuit arrangement includes a coupling circuit having a low pass filter section coupled to the resonators of one of the resonator sections and is bonded to the region of that resonator section on the open-circuit end surface of the dielectric duplexer at a rear layered side portion thereof.

8. A dielectric duplexer device as claimed in claim 6, wherein said band pass filter circuit section includes conductor layers disposed on the open-circuit end surface of the resonators corresponding to the region of the other resonator section and connected to the inner conductors of the respective resonators of that section, said conductor layers being capacitively coupled with each other.

9. A dielectric duplexer device as claimed in claim 1, wherein said laminated circuit arrangement comprises a single chip formed by laminating and baking a plurality of dielectric sheet members, the single chip being mounted on the dielectric duplexer.

* * * * *